US007850467B2

(12) United States Patent
Heinzig et al.

(10) Patent No.: US 7,850,467 B2
(45) Date of Patent: Dec. 14, 2010

(54) CONNECTING ELEMENT FOR AN ELECTRICAL SHIELDING ARRANGEMENT

(75) Inventors: Peter Heinzig, Wendelstein (DE); Jens Hoppe, Schwarzenbruck (DE); Thomas Kuderna, Nürnberg (DE); Lambert Schummer, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 226 days.

(21) Appl. No.: 12/293,963

(22) PCT Filed: Mar. 15, 2007

(86) PCT No.: PCT/EP2007/052426

§ 371 (c)(1),
(2), (4) Date: Oct. 21, 2008

(87) PCT Pub. No.: WO2007/107492

PCT Pub. Date: Sep. 27, 2007

(65) Prior Publication Data

US 2009/0130871 A1 May 21, 2009

(30) Foreign Application Priority Data

Mar. 21, 2006 (DE) ..... 10 2006 013 927

(51) Int. Cl.
*H01R 4/66* (2006.01)
*H01R 13/648* (2006.01)

(52) U.S. Cl. ..... 439/99; 439/607.02

(58) Field of Classification Search ..... 439/98, 439/99, 108, 607.01–607.05
See application file for complete search history.

(56) References Cited

U.S. PATENT DOCUMENTS

| | | | | |
|---|---|---|---|---|
| 4,310,209 | A * | 1/1982 | Fleming et al. | 439/99 |
| 2005/0164534 | A1 * | 7/2005 | Li | 439/108 |
| 2009/0000805 | A1 * | 1/2009 | Hammer et al. | 174/142 |
| 2009/0205863 | A1 * | 8/2009 | Heinzig et al. | 174/365 |
| 2009/0275234 | A1 * | 11/2009 | Gilliam | 439/607.02 |

FOREIGN PATENT DOCUMENTS

| | | |
|---|---|---|
| DE | 19530163 A1 | 2/1997 |
| JP | 58124215 A | 7/1983 |

OTHER PUBLICATIONS

German Office Action dated Oct. 5, 2006.

* cited by examiner

*Primary Examiner*—Chandrika Prasad
(74) *Attorney, Agent, or Firm*—Laurence A. Greenberg; Werner H. Stemer; Ralph E. Locher

(57) ABSTRACT

A connecting element between a first electric shielding assembly that surrounds a cable feedthrough and includes at least one tubular insulating barrier that surrounds the cable feedthrough and at least one second electric shielding assembly that surrounds the cable feedthrough and includes at least one tubular insulating barrier that surrounds the cable feedthrough. A continuous barrier system around the cable feedthrough is provided by a connecting element with at least two interconnecting insulating barriers, which can be inserted into the shielding assemblies, even if the shielding assembly is configured from sub-segments. The disclosure also relates to an electric shield for a cable feedthrough and to a method for producing an electric shield for a cable feedthrough.

19 Claims, 3 Drawing Sheets

CONNECTING ELEMENT FOR AN ELECTRICAL SHIELDING ARRANGEMENT

BACKGROUND OF THE INVENTION

Field of the Invention

The invention relates to a connecting element for connection of a first electrical shielding arrangement which is arranged around a line bushing, to at least one tubular isolating barrier which is arranged around the line bushing, and to at least one second electrical shielding arrangement, which is arranged around the line bushing and has at least one tubular isolating barrier which is arranged around the line bushing. The invention likewise relates to an electrical shield for a line bushing and to a method for production of an electrical shield for a line bushing.

The electrical connection of electrical installations, in particular of high-voltage installations, requires a large amount of technical complexity for the electrical shielding of the feeding and outgoing voltage lines. Particularly in the case of outgoers and bushings for electrical installations, electrical shielding must be provided at all times and over the entire line route. Particularly in situations in which the electrical installation is an oil-cooled transformer or an induction coil for high operating voltages, the line route is arranged in a grounded dome, which contains oil, of the corresponding electrical installation.

Electrical shielding of the line bushing is essential in particular for high DC voltages, such as those which occur in high-voltage direct-current transmission systems (HVDC). The electrical and mechanical loads which occur in this case must be compensated for by the oil-filled barrier system in conjunction with the tubular electrode at all times and for all possible voltage situations. This can be achieved only by means of a continuous barrier arrangement as an electrical shield around the line bushing.

For example, DE 690 24 335 T2 describes a bush for high DC voltages. According to the invention there, the electrical field is controlled capacitively by means of a capacitor body arranged around the disconnection point. In this case, a position in the axial direction with respect to the line bushing is defined as a function of the radii, arranged in one another, of the capacitor body, which position is in the form of a straight truncated cone aligned along the line bushing.

Furthermore, DE 690 12 258 T2 discloses a capacitor internal wall for field control of the line connection of a transformer bushing. According to the invention there, the capacitor isolating wall prevents any flashover of the electrical voltage, in that this barrier is suitable for capacitive and resistive control of the electrical field and is designed such that the voltages and field strength which occur in the respective area do not lead to destruction of the barriers.

The design of a high-voltage transformer, in particular of a HVDC transformer, is subject to the problem that the barriers of the electrical shielding must be shortened within a tank housing which remains unchanged because the transformer windings are becoming ever larger and because this results in the distance between the transformer windings and the tank wall becoming too short. The overlap, which is required for isolation reasons, between the shielding on the winding side and the shielding of the outgoer from the tank housing is therefore no longer provided without problems when using a conventional design.

All of the solutions in the prior art are subject to the disadvantage that conventional shielding arrangements around a high-voltage line bushing, in particular for HVDC applications, do not provide a complete overlap of the barrier systems of the shielding arrangements.

BRIEF SUMMARY OF THE INVENTION

The object of the present invention is therefore to provide electrical shielding around a line bushing, which ensures quick and simple arrangement of continuous shielding around the line bushing, even when subject to poor physical preconditions within a tank area.

The problem on which the invention is based is solved by the features of claim 1. According to the invention, a connecting element can be pushed into the electrical shielding arrangements and has at least two tubular isolation barriers, with the two tubular isolation barriers being connected to one another. As a result of the isolation barriers that are connected to one another, the connecting element bridges any possible separation between the barriers of the first and of the second electrical shielding arrangements. At the same time, the connection of the two isolating barriers ensures that, on the one hand, an appropriate electrical strength is ensured as electrical shielding and on the other hand that mechanical robustness of the connecting element is ensured. The isolation barriers, which are connected to one another, can then be pushed into the shielding arrangements thus allowing a simple and quick arrangement of the electrical shielding around the line bushing.

For the purposes of the invention, tubular means that the elements correspondingly referred to in this way have a longitudinal extent in the axial direction of the line route and are formed over a virtually circular cross section. In this case, however, the respective element referred to in this way need not be completely in the form of a tube but may also have cutouts and partial openings in segments.

The definition "circular" for the purposes of the invention also comprises cross sections which differ from this, for example elliptical, triangular or polygonal shapes.

The invention provides that the two tubular isolation barriers can be pushed into each of the tubular isolating barriers of the first and of the second electrical shielding arrangements. This ensures a direct and continuous structure of a barrier arrangement, even when the entire shield on the line bushing comprises a plurality of segments.

In one advantageous refinement of the connecting element, the tubular isolation barriers are connected to one another by means of at least one spacer. The tubular isolation barriers and/or the spacer are/is advantageously at least partially composed of an insulation material, in particular pressboard.

The invention provides for the length of the tubular isolation barriers to be different. This ensures on the one hand the best possible fit of the connecting element to an intermediate space between a first and a second shielding arrangement. At the same time, electrical and mechanical loads can be compensated for by the isolation barrier lengths, which are stepped radially with respect to the line bushing of the connecting element. Furthermore, stepped isolation barrier systems make it easier to push the connecting element into a shielding arrangement in that the connecting element is guided by individual isolation barriers along appropriately corresponding guides of the shielding arrangements.

The spacer is shaped such that, on the one hand, the intermediate distances between the tubular isolation barriers on the side facing the first electrical shielding arrangement and the intermediate distances between the barriers of the first electrical shielding arrangement correspond. Alternatively or additionally, the intermediate distances between the tubular isolation barriers on the side facing the second electrical shielding arrangement and the intermediate distances between the barriers of the second electrical shielding arrangement likewise correspond. Even if the intermediate distances between the barriers in the first and the second shielding arrangements are different, the correspondingly shaped spacers between the isolation barriers ensure a continuous connection of the barrier arrangement. In this situation, the isolation barriers are then not aligned parallel and concentrically with respect to the rotation axis of the line bushing, but, for example, have a conical arrangement with respect to the line bushing. The connecting element can thus compensate for discrepancies in the intermediate distances between the individual barriers of the first shielding arrangement in comparison to the intermediate distances between the barriers of the second shielding arrangement.

The spacer is advantageously in the form of a ring and/or block. According to the invention, at least two spacers are arranged equidistantly on a circular surface of a tubular isolation barrier.

In one advantageous refinement of the invention, the tubular isolation barriers can be combined to form module elements, and can be connected to one another via the spacers. The connecting element according to the invention is formed from module elements which can themselves be connected by means of spacers. The spacers ensure that the respective module elements are mechanically robust. The connecting element may be composed of modular assemblies of the isolation barriers in the form of the module elements, and can be constructed easily. Spacers which are arranged radially on the outside and/or inside can be used on the isolation barriers which have been combined as module elements for mutual attachment of the module elements. The spacers may in this case be plugged-in to one another as plug-in systems by means of corresponding plug-in apparatuses, for example via a tongue-and-groove connection. Alternatively, the spacers can be connected between the module elements by means of conventional attachment elements, such as screws.

According to the invention, an insulation liquid, in particular an oil, can circulate between the barriers of the first and of the second electrical shielding arrangements, and between the tubular isolation barriers. In order to connect the first electrical shielding arrangement and the second electrical shielding arrangement, a plurality of connecting elements are used to bridge a longitudinal distance between the first and the second electrical shielding arrangements, in which case the connecting elements can be pushed into one another. Any distance between two shielding arrangements can be bridged by a modular structure comprising a plurality of connecting elements which can each be pushed into one another. This not only allows a modular structure of the connecting elements per se, but at the same time a modular system structure of a plurality of connecting elements.

The connecting element for connection of the electrical shielding arrangement of a transformer winding can be connected to a line bushing of a transformer housing. The distance between the individual isolation barriers is advantageously not greater than 300 mm, for isolation reasons.

In one advantageous refinement of the connecting element according to the invention, a plurality of spacers are arranged, with respect to the line bushing, radially and/or axially offset with respect to one another between the isolation barriers. The connecting element can be arranged by means of at least one spacer on a control electrode which is arranged around the line bushing.

The object is likewise achieved by the features of claim 16. According to the invention, according to the method for production of an electrical shield around a line bushing, a first electrical shielding arrangement is first of all produced, having at least one tubular isolating barrier which is arranged around the line bushing. A connecting element having at least two tubular isolation barriers, which are at least partially connected to one another, is pushed into the first electrical shielding arrangement, and is then fixed in this first shielding arrangement. The attachment can be effected by mechanical bracing of the barriers with respect to one another and/or by means of external retention. The connecting element is then connected to a second electrical shielding arrangement by means of at least one tubular isolating barrier which is arranged around the line bushing. The object is also achieved by the electrical shielding around a line bushing as claimed in claim 17.

Further advantageous refinements result from the dependent claims. Some of the exemplary refinements will be explained with reference to the figures, in which:

DESCRIPTION OF THE INVENTION

Figure 1:
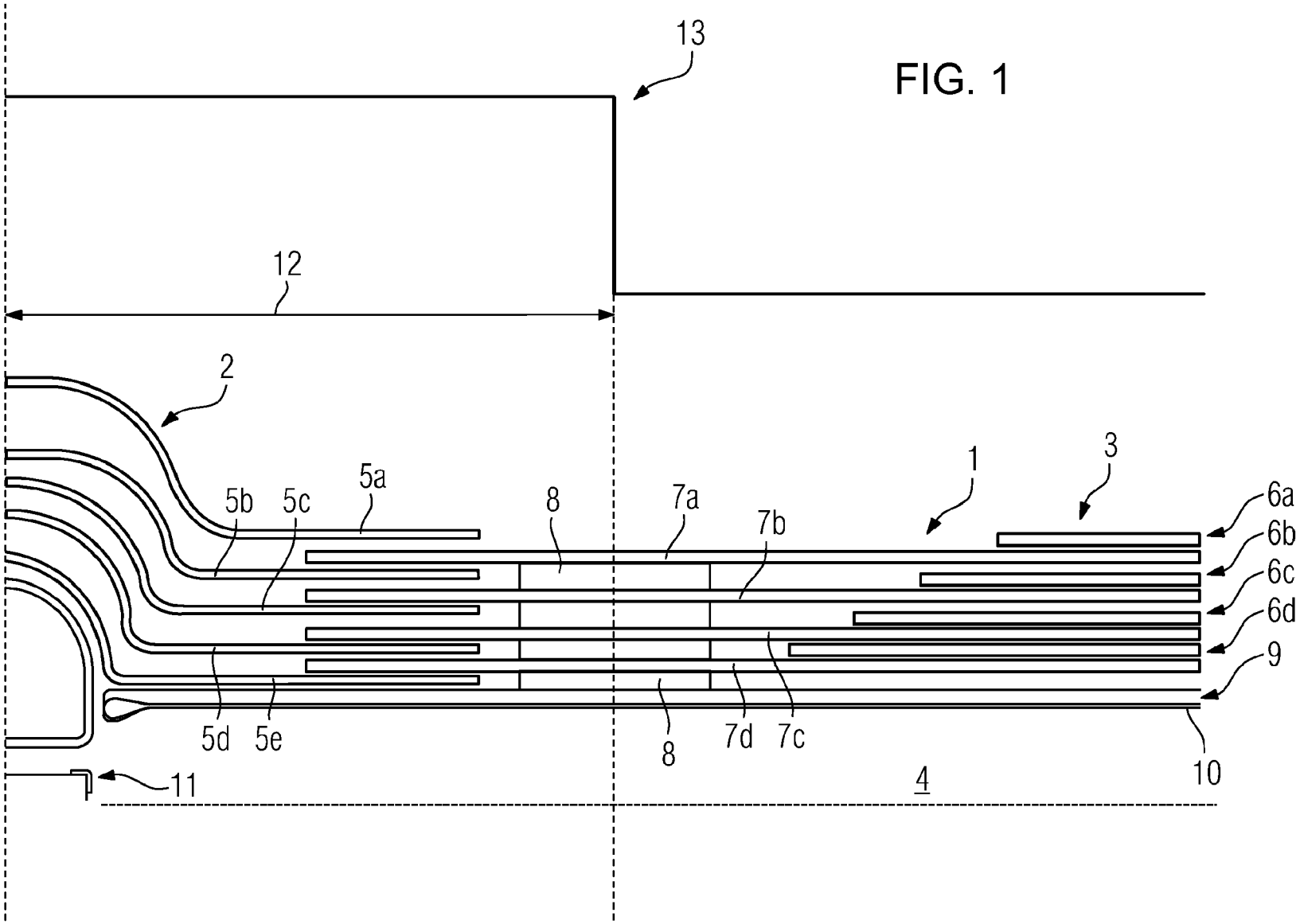
FIG. 1 shows a schematic side view of a connecting element according to the invention between two electrical shielding arrangements.
Figure 2A:
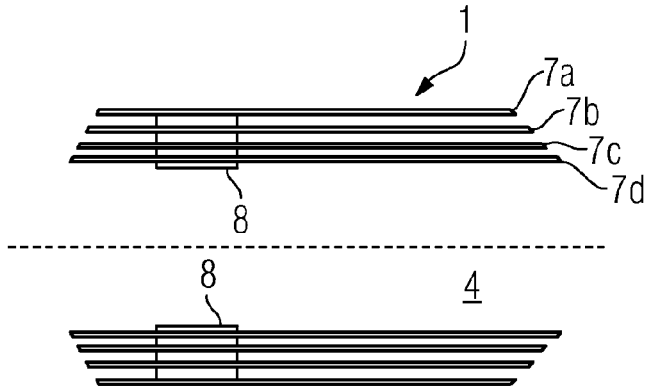
FIGS. 2*a*, 2*b*, 2*c*, 2*d* show a schematic view of connecting elements according to the invention with different steps in the axial direction.
Figure 2B:
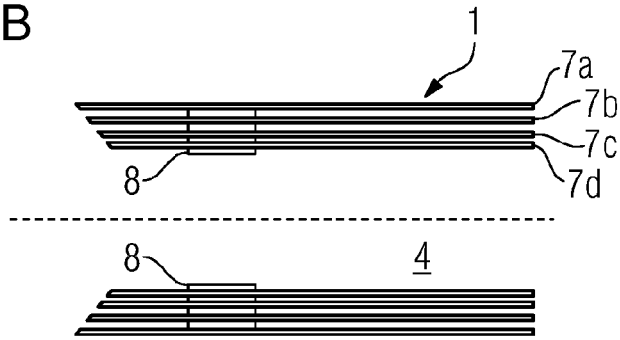
Figure 2C:
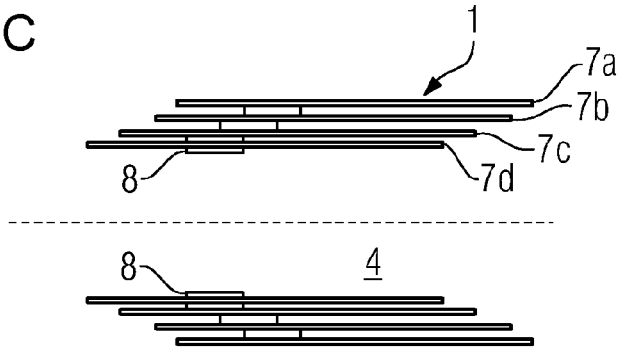
Figure 2D:
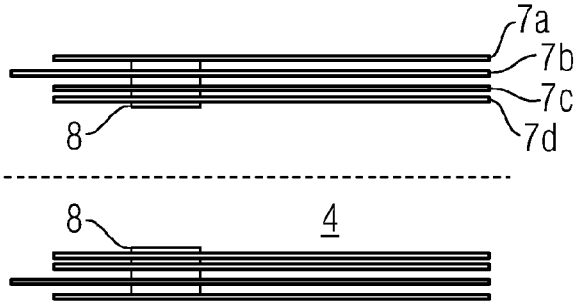

FIG. 1 shows a schematic side view of the connecting element 1 according to the invention between a first electrical shielding arrangement 2 of a transformer winding 14 (not illustrated) and a second electrical shielding arrangement 3 for a line bushing from the transformer housing 13. The first electrical shielding arrangement 2 has barrier elements 5*a*, 5*b*, 5*c*, 5*d*, 5*e*, which are arranged around a winding former 11. A tubular control electrode 10 composed of copper is arranged around the line bushing 4, for isolation and for field guidance. The control electrode 10 is partially insulated by a paper layer 9. The line bushing 4, the control electrode 10, the first and second shielding arrangements 2, 3 and the connecting element 1 are rotationally symmetrical with respect to the axis that is shown as a dashed line.

This rotational symmetry does not, however, represent any restriction to the subject matter of the invention since, for the purposes of the invention, partially rotationally symmetrical or segment-by-segment barrier arrangements 5*a*, 5*b*, 5*c*, 5*d*, 5*e*, 6*a*, 6*b*, 6*c*, 6*d*, 7*a*, 7*b*, 7*c*, 7*d* are likewise also claimed by the features of the patent claims.

The first electrical shielding arrangement 2 is arranged in the radial direction with respect to the control electrode 10. Because of high-voltage requirements the distance 12 between the windings 11 and the corresponding tank wall 13 must not be less than a specific minimum. The barrier elements 5*a*, 5*b*, 5*c*, 5*d*, 5*e* of the first electrical shielding arrangement 2 are, however too short for this purpose in order to ensure the insertion of the transformer active part. The second electrical shielding arrangement 3 for the line bushing 4 can likewise not be pushed into the first electrical shielding arrangement 2. The connecting element 1 according to the invention is therefore pushed in between the barrier system 5*a*, 5*b*, 5*c*, 5*d*, 5*e* of the first electrical shielding arrangement 2 and the barrier system 6*a*, 6*b*, 6*c*, 6*d* of the second electrical shielding arrangement 3. Because of the known intermediate distances between the individual barrier elements 5*a*, 5*b*, 5*c*, 5*d*, 5*e* and 6*a*, 6*b*, 6*c*, 6*d* of the first electrical shielding arrangement 2 and of the second electrical shielding arrangement 3, respectively, the spacers 8 of the connecting element 1 can be chosen so as to respectively ensure that the tubular isolation barriers 7*a*, 7*b*, 7*c*, 7*d* are inserted with an accurate fit into the respectively corresponding openings in the first 5*a*, 5*b*, 5*c*, 5*d*, 5*e* and in the second barrier system 6*a*, 6*b*, 6*c*, 6*d*. Furthermore, an oil can circulate as an isolation medium in this barrier arrangement 5*a*, 5*b*, 5*c*, 5*d*, 5*e*, 6*a*, 6*b*, 6*c*, 6*d*, 7*a*, 7*b*, 7*c*, 7*d* as sufficiently for an oil gap to the tank wall 13 is likewise ensured above the connecting element 1. The spacers 8 between the isolation barriers 7*a*, 7*b*, 7*c*, 7*d* are in the form of rings or blocks.

FIG. 2 shows different refinements of the connecting elements 1 according to the invention. The axial length of the respective tubular isolation barriers 7*a*, 7*b*, 7*c*, 7*d* may in this case be different. The spacers 8 are likewise advantageously positioned differently between the tubular isolation barriers 7*a*, 7*b*, 7*c*, 7*d* in the radial and/or axial direction—with respect to the longitudinal extent of the line bushing 4. This ensures that the isolation barriers 7*a*, 7*b*, 7*c*, 7*d*, could be pushed into the barrier system 5*a*, 5*b*, 5*c*, 5*d*, 5*e* of the first electrical shielding arrangement 2 and the barrier system 6*a*, 6*b*, 6*c*, 6*d* of the second electrical shielding arrangement 3.

Figure 3:
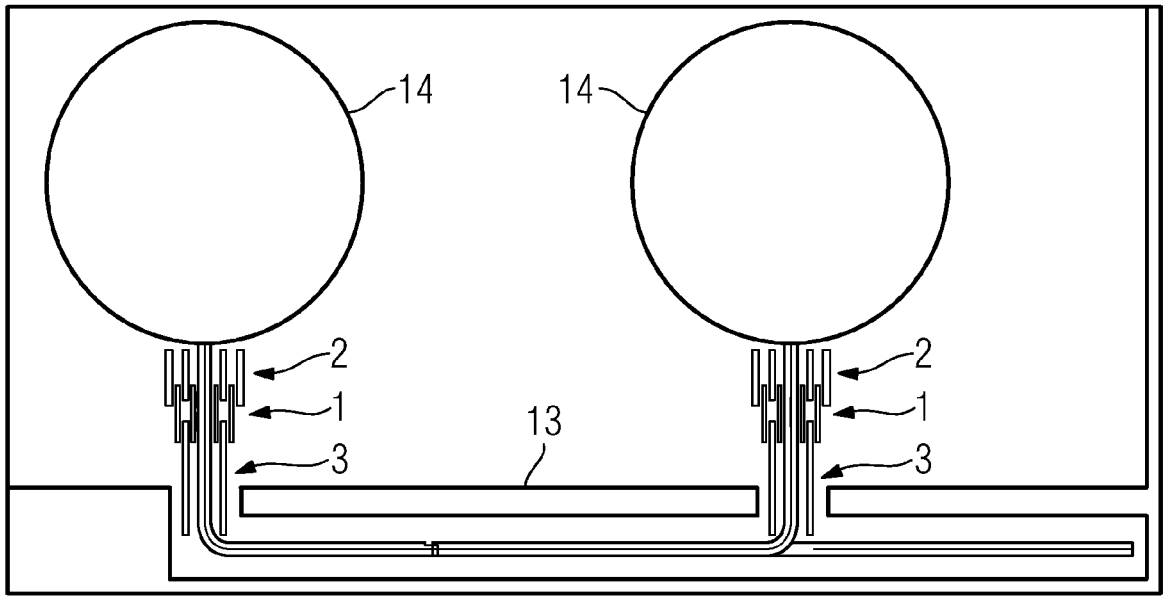
FIG. 3 shows a schematic view of electrical shielding arrangements each having a connecting element according to the invention for connection of two windings.

FIG. 3 shows a schematic plan view of an HVDC transformer with a connecting element 1 according to the invention. The barriers 5*a*, 5*b*, 5*c*, 5*d*, 5*e* which are in the form of chimneys, of the first electrical shielding arrangement 2 are connected at the windings 11 of the HVDC transformer by means of the connecting element 1 to the barrier system 6*a*, 6*b*, 6*c*, 6*d* around the line outgoer from the transformer housing. This ensures that the electrical fields which occur during operation are guided within the barrier arrangement 5*a*, 5*b*, 5*c*, 5*d*, 5*e*, 6*a*, 6*b*, 6*c*, 6*d*, 7*a*, 7*b*, 7*c*, 7*d*. Furthermore, the connecting element 1 ensures that the first electrical shielding arrangement 2 is connected with an accurate fit to the second electrical shielding arrangement 3 as a tank outgoer.

The invention claimed is:

1. A connecting element assembly for connecting a first electrical shielding arrangement and at least one second electrical shielding arrangement, wherein the first shielding arrangement is disposed around a line bushing and includes at least one tubular isolating barrier arranged around the line bushing; and the second electrical shielding arrangement is arranged around the line bushing and has at least one tubular isolating barrier arranged around the line bushing;

the connecting element assembly comprising:

a connecting element configured to be pushed into the first and second electrical shielding arrangements, having at least two tubular isolation barriers, and said tubular isolation barriers being connected to one another.

2. The connecting element assembly according to claim 1, wherein said tubular isolating barriers are configured to be pushed into the respective tubular isolating barriers of the first and of the second electrical shielding arrangements.

3. The connecting element assembly according to claim 1, which comprises at least one spacer connecting said tubular isolation barriers to one another.

4. The connecting element assembly according to claim 3, wherein at least one of said tubular isolation barriers and said spacer is at least partially composed of an insulation material.

5. The connecting element assembly according to claim 4, wherein the insulation material is pressboard.

6. The connecting element assembly according to claim 1, wherein the respective said tubular isolation barriers have mutually different axial lengths.

7. The connecting element assembly according to claim 3, wherein:

said tubular isolation barriers have a first side facing the first electrical shielding arrangement and a second side facing the second electrical shielding arrangement; and said spacer is shaped such that:

respective intermediate distances between said tubular isolation barriers on said first side and respective intermediate distances between the barriers of the first electrical shielding arrangement; and/or respective intermediate distances between said tubular isolation barriers on said second side and respective intermediate distances between the barriers of the second electrical shielding arrangement correspond to one another.

8. The connecting element assembly according to claim 3, wherein said spacer is shaped in a form selected from the group consisting of a ring and a block.

9. The connecting element assembly according to claim 1, which comprises at least two spacers disposed equidistantly on a cross-sectional surface of at least one said tubular isolation barrier.

10. The connecting element assembly according to claim 1, which comprises an insulation liquid circulating between the barriers of the first and second electrical shielding arrangements and between said tubular isolation barriers.

11. The connecting element assembly according to claim 10, wherein said insulation liquid is oil.

12. The connecting element assembly according to claim 1, wherein said connecting element is one of a plurality of connecting elements disposed to connect the first electrical shielding arrangement and the second electrical shielding arrangement, said plurality of connecting elements bridging a longitudinal distance between the first and the second electrical shielding arrangements and said plurality of connecting elements being pushed into one another.

13. The connecting element assembly according to claim 1, wherein said tubular isolation barriers are combinable to form module elements, and further comprising a plurality of spacers connecting said module elements to one another.

14. The connecting element assembly according to claim 1, wherein said connecting element is configured for connection to a line bushing of a transformer housing, for connecting an electrical shielding arrangement of a transformer winding.

15. The connecting element assembly according to claim 1, wherein a distance between individual said isolation barriers is not greater than 300 mm.

16. The connecting element assembly according to claim 1, which comprises at least two spacers disposed, with respect to the line bushing, with a radial and/or axial offset relative to one another between said isolation barriers.

17. The connecting element assembly according to claim 1, wherein said connecting element is disposed, by way of at least one spacer, on a control electrode arranged around the line bushing.

18. An electrical shield around a line bushing, comprising:

a first electrical shielding arrangement with at least one tubular isolating barrier arranged around the line bushing;

at least one second electrical shielding arrangement having at least one tubular isolating barrier arranged around the line bushing; and at least one connecting element according to claim 1 for connection of said first and second shielding arrangements.

19. A method of producing an electrical shield around a line, the method which comprises the following steps:

providing a first electrical shielding arrangement having at least one tubular isolating barrier disposed around the line bushing;

inserting a connecting element having at least two tubular isolation barriers, at least partially connected to one another, into the first electrical shielding arrangement;

mounting the electrical element in the first electrical shielding arrangement;

providing a second electrical shielding arrangement with at least one tubular isolating barrier arranged around the line bushing, and connecting the second shielding arrangement to the connecting element.

* * * * *